US009963947B2

(12) United States Patent
Kjøsnes et al.

(10) Patent No.: US 9,963,947 B2
(45) Date of Patent: May 8, 2018

(54) APPARATUS AND METHOD FOR CONTROLLING PRESSURE IN A BOREHOLE

(71) Applicant: STATOIL PETROLEUM AS, Stavanger (NO)

(72) Inventors: Ivar Kjøsnes, Trondheim (NO); Nils Lennart Rolland, Nyborg (NO)

(73) Assignee: STATOIL PETROLEUM AS, Stavanger (NO)

( * ) Notice: Subject to any disclaimer, the term of this patent is extended or adjusted under 35 U.S.C. 154(b) by 613 days.

(21) Appl. No.: 14/404,863

(22) PCT Filed: Oct. 24, 2012

(86) PCT No.: PCT/EP2012/071043

§ 371 (c)(1),
(2) Date: Dec. 1, 2014

(87) PCT Pub. No.: WO2013/178295

PCT Pub. Date: Dec. 5, 2013

(65) Prior Publication Data

US 2015/0275602 A1 Oct. 1, 2015

(30) Foreign Application Priority Data

Jun. 1, 2012 (GB) ..... 1209844.8

(51) Int. Cl.
*E21B 21/08* (2006.01)
*E21B 43/12* (2006.01)
(Continued)

(52) U.S. Cl.
CPC ..... *E21B 21/08* (2013.01); *E21B 21/001* (2013.01); *E21B 33/085* (2013.01); *E21B 43/12* (2013.01); *E21B 2021/006* (2013.01)

(58) Field of Classification Search
CPC ..... E21B 21/001; E21B 21/08; E21B 33/085; E21B 43/12; E21B 2021/006
See application file for complete search history.

(56) References Cited

U.S. PATENT DOCUMENTS 6,102,673 A * 8/2000 Mott ..... E21B 21/001 137/596.17
6,142,236 A 11/2000 Brammer et al.
(Continued)

FOREIGN PATENT DOCUMENTS

WO WO 2006/031119 A1 3/2006
WO WO 2006/054905 A1 5/2006
(Continued)

*Primary Examiner* — Matthew R Buck
(74) *Attorney, Agent, or Firm* — Birch, Stewart, Kolasch & Birch, LLP

(57) ABSTRACT

There is described a technique for drilling and controlling the fluid pressure of a borehole (2, 102) during drilling of the borehole. In embodiments of the invention, drill pipe (5) may be arranged in said borehole, the pipe being configured to provide drilling fluid in the borehole. Sealing means (14, 18, 114, 118) may be provided and arranged to sealingly abut an outer surface of the drill pipe to separate said drilling fluid in the borehole on a first side of the sealing means from a column of fluid on a second side of the sealing means. Furthermore, a subsea pump arrangement (12, 112) may be arranged under a sea surface where it receives a flow of said drilling fluid from the borehole. The pump arrangement can operate to pump drilling fluid out of the pump arrangement, and generate a fluid pressure in said drilling fluid at a location upstream of the pump arrangement, said generated pressure being less than or equal to the hydrostatic pressure of said column of fluid on said second side of the sealing means.

18 Claims, 3 Drawing Sheets

(51) Int. Cl.
*E21B 33/08* (2006.01)
*E21B 21/00* (2006.01)

(56) References Cited

U.S. PATENT DOCUMENTS 6,904,982 B2 * 6/2005 Judge ..... E21B 21/001 166/84.4
7,735,563 B2 * 6/2010 Judge ..... E21B 43/121 166/344
7,913,764 B2 * 3/2011 Smith ..... E21B 21/001 166/345
7,938,190 B2 * 5/2011 Talamo ..... E21B 19/002 166/358
7,958,948 B2 * 6/2011 Stave ..... E21B 21/001 166/344
8,322,435 B2 * 12/2012 Judge ..... E21B 43/121 166/344
9,316,054 B2 * 4/2016 Weinstock ..... E21B 7/12
2001/0050185 A1 * 12/2001 Calder ..... E21B 21/001 175/5
2002/0066569 A1 6/2002 Schubert et al.
2003/0066650 A1 * 4/2003 Fontana ..... E21B 7/12 166/358
2003/0139916 A1 7/2003 Choe et al.
2004/0031622 A1 * 2/2004 Butler ..... E21B 21/001 175/5

FOREIGN PATENT DOCUMENTS

WO WO 2009/123475 A1 10/2009
WO WO 2012/003101 A2 1/2012
WO WO 2012/091706 A1 7/2012

* cited by examiner

APPARATUS AND METHOD FOR CONTROLLING PRESSURE IN A BOREHOLE

TECHNICAL FIELD

The present invention relates to drilling of a well, and in particular to improving the control of fluid pressure in a borehole during drilling.

BACKGROUND

During the drilling of a sub-surface well, it is typically desirable that the pressure conditions in the borehole are controlled. This may be to reduce the risk of blow-outs or well kicks where a sudden build-up and release of pressure may occur deep in the borehole and may be communicated back to a drilling rig at the surface.

Such a well is typically drilled using drilling apparatus comprising drill pipe fitted with a drill bit for penetrating into a subsurface, for example by rotation of the drill pipe from a surface platform. A drilling fluid is conveyed through the inside of the drill pipe and delivered into the borehole as drilling progresses. Drilling fluid is returned back up toward the surface through an annular space outside of the drill pipe, between the drill pipe and the wall of the borehole. The drilling fluid may help to lubricate and cool the drill bit and may help carry drill cuttings and debris out of the well. The drilling fluid also plays an important role in controlling the fluid pressure in the borehole, and is often selected to have a density with the aim of providing a particular pressure in the borehole.

Typically, it is desired that the pressure in the borehole be controlled to be higher than the pressure of the formation (overbalanced drilling). This helps to prevent influx of fluids from the formation and collapse of the formation into the borehole during drilling. More specifically, the pressure in the borehole may be sought to be higher than the pore fluid pressure but less than the fracture pressure of the formation. In some situations, depending on lithology and burial conditions of a formation, the fracture pressure may not be much higher than the pore pressure, resulting in a narrow pressure margin within which to maintain borehole pressure in order to drill the well in overbalanced conditions.

In such situations, accurate control of the pressure conditions in the borehole is required. The drilling fluid may be selected such that a desired pressure in the borehole can be achieved. A difficulty is that the drilling fluid in the borehole picks up cuttings or debris from the borehole, such that the density of the drilling fluid in the borehole may differ from that delivered through the drill pipe.

In typical offshore drilling, the drilling fluid is passed through a drill pipe from a floating drilling vessel to the bottom of the well, and the drilling fluid is returned from the borehole through a passage between the drill pipe and a drilling riser. The pressure in the borehole at the penetration depth of the formation includes the hydrostatic pressure imparted by the drilling fluid extending from the bottom of the borehole all the way to the surface (top of the drilling riser) plus the equivalent circulating density (ECD) of the drilling fluid when it is circulating.

In deep water drilling operations, this may pose difficulties because the drilling fluid extends within the drilling riser a significant distance through the water column. In particular, it can mean highly constrained pressure margins between pore and fracture pressures of the formation, and it can be problematic to control the pressure in the borehole accordingly.

For deep water drilling, it has been proposed therefore to use dual gradient drilling methods, where the riser has a lower density fluid above a certain depth. At that depth, a seal is formed around the drill pipe, separating the lower density fluid above from the drilling fluid below. Such seals are typically called rotating control devices (RCDs) although such seals are not always configured to rotate. Such an arrangement results in a first pressure gradient with depth in the riser annulus for the interval spanning the lower density fluid, and a greater pressure gradient with depth in the annulus below that level. It is documented that such an approach can help to expand the drilling length within given pressure margins.

There have also been proposed methods where an RCD seal is provided in a similar way, but there is no riser fitted above the seal (for example, as in deep-water riserless drilling). A dual gradient effect is achieved, but the hydrostatic pressure above the seal is given by that provided by the seawater above the seal.

In dual gradient and/or riserless drilling configurations such as these, a subsea pump is required to lift the return flow of drilling fluid back to the surface through a separate mud return line. The subsea pump is typically placed at or near the same depth as that of the seal.

For this purpose, it has been proposed to use subsea pump in the form of a positive displacement pump that is driven by seawater, using the hydrostatic pressure of seawater plus pump pressure from rig-based pumps. The minimum drive pressure may be the hydrostatic pressure of seawater at the pump or above the seal.

An example subsea positive displacement pump is described in the patent publication U.S. Pat. No. 6,904,982.

SUMMARY OF THE INVENTION

According to a first aspect of the invention, there is provided apparatus for drilling and controlling the fluid pressure of a borehole during said drilling of the borehole, the apparatus comprising:

- drill pipe arranged to be located in said borehole, said pipe configured to provide drilling fluid to the borehole;
- sealing means arranged to sealingly abut an outer surface of the drill pipe to separate said drilling fluid in the borehole on a first side of the sealing means from a fluid on a second side of the sealing means;
- a subsea pump arrangement arranged to be located under a sea surface, said pump arrangement arranged to receive therein a flow of said drilling fluid from the borehole;
- wherein said pump arrangement is operable to pump said received drilling fluid out of the pump arrangement and to generate a fluid pressure in said drilling fluid at a location upstream of the pump arrangement, said generated pressure being less than or equal to the hydrostatic pressure of said fluid on said second side of the sealing means.

The generated pressure may be in a range of up to around 50 bar less than said hydrostatic pressure.

The pump arrangement may comprise: a positive displacement pump configured to be driven by means of a drive fluid; and a centrifugal pump arranged to receive said drive fluid from the positive displacement pump and operate on the drive fluid to change a pressure in said drive fluid.

The pump arrangement may comprise at least one such positive displacement pump. The pump arrangement may comprise at least one such centrifugal pump. The positive displacement pump and centrifugal pump may be operable together to produce said pressure upstream of the pump arrangement. The positive displacement pump may comprise:

a drive member which may be arranged to act on said drilling fluid received in the pump arrangement;

a drive chamber which may be arranged to receive a drive fluid for moving and/or exerting a force against said drive member to drive drilling fluid out of the pump arrangement; and directing means for directing drive fluid into and out of said drive chamber;

wherein the centrifugal pump may be arranged to receive drive fluid from the drive chamber, and may be operable to pump said drive fluid to control a pressure in the drive fluid upstream of the centrifugal pump.

The pump arrangement may define a first route along which drilling fluid can pass through the pump arrangement, and a second route, separate to the first route, along which drive fluid can pass through the pump arrangement, separately of the drilling fluid. The drive fluid may be seawater. Thus, the positive displacement pump may be configured to be supplied with seawater to drive the pump. The seawater to drive the positive displacement pump may be supplied from a location above the pump, in use.

Said location upstream of the pump arrangement may be within said borehole, or may be at an inlet of the pump arrangement. The sealing means may be arranged to be positioned at a depth below the surface of the sea, for example, arranged to be positioned at or above the seafloor.

The pump arrangement may be arranged to be placed at substantially the same depth below the sea surface as the sealing means or at a depth below or above that of the sealing means. In use, said fluid on the second side of the sealing means may overlie the sealing means and the drilling fluid on the first side of the sealing means. The sealing means may comprise at least one seal arranged to seal against the drill pipe. The seal is a dynamic seal arranged to permit relative movement between the drill pipe and the seal, for example rotation of the drill pipe stroking with respect to the seal.

The sealing means may comprise a static seal or a rotary control device (RCD).

The borehole may have a conduit mounted thereto, through which conduit the drill pipe may be passed when inserted in the borehole, and through which drilling fluid can flow from the borehole. The sealing means may be connected to said conduit.

Said fluid on the second side of the seal comprises fluid may have a lower density than that of the drilling fluid in the borehole. Said fluid on the second side of the seal may comprise seawater. Said fluid on the second side of the seal may comprise fluid having a density lower than that of seawater.

The drill pipe in an interval between the sea floor and the sea surface may be disposed within a riser pipe. The pump arrangement may be mounted to said riser pipe.

Said fluid on the second side of the sealing means may be contained in a region between an outer surface of the drill pipe and said riser pipe. The drilling fluid on said first side of the sealing means may be contained in a region between the outer surface of the drill pipe and said riser pipe, said region fluidly connected with the borehole for flow of drilling fluid therethrough.

The apparatus may have a controller to control the operation of the pump arrangement. The pump arrangement may be controllable to control said drilling fluid pressure upstream of the pump arrangement.

The apparatus may further include a measurement device for measuring a condition of the borehole, and wherein the pump arrangement may be operable in dependence upon said condition to produce said drilling fluid pressure upstream of the pump arrangement.

According to a second aspect of the invention, there is provided a method of drilling and controlling fluid pressure of a borehole during drilling, the method comprising the steps of:

(a) providing drill pipe in said borehole;

(b) providing sealing means in sealing abutment against an outer surface of said drill pipe;

(c) providing drilling fluid in the borehole by means of the drill pipe;

(d) using the sealing means to separate said drilling fluid in the borehole on a first side of the sealing means from a column of fluid on a second side of the sealing means;

(e) locating a subsea pump arrangement under the sea surface;

(f) receiving a flow of said drilling fluid from the borehole in said pump arrangement; and (g) generating a fluid pressure in said drilling fluid from the borehole at a location upstream of the pump arrangement by operating the subsea pump arrangement, said generated fluid pressure being less than or equal to the hydrostatic pressure of said fluid on said second side of the sealing means.

According to a third aspect of the invention, there is provided a subsea pump arrangement arranged to be located under the sea surface for use in controlling fluid pressure in a borehole, wherein said borehole is provided with drill pipe located therein, said drill pipe arranged to provide drilling fluid in the borehole, said drill pipe being provided with sealing means in sealing abutment with an outer surface of the drill pipe, said sealing means separating the drilling fluid in the borehole on a first side of the seal and fluid on a second side of the seal, the pump arrangement comprising:

at least one pump arranged to receive drilling fluid from said borehole;

said at least one pump being operable to pump said received drilling fluid so as to generate a pressure in said drilling fluid at a location upstream of the pump, said generated pressure being less than or equal to the hydrostatic pressure of said fluid on the second side of the sealing means.

According to a further aspect of the invention, there is provided apparatus for drilling and controlling the fluid pressure of a borehole during said drilling of the borehole, the apparatus comprising:

drill pipe arranged to be located in said borehole, said pipe configured to provide drilling fluid to the borehole;

a subsea pump arrangement arranged to be located under a sea surface, said pump arrangement arranged to receive therein a flow of said drilling fluid from the borehole;

wherein said pump arrangement is operable to pump said received drilling fluid out of the pump arrangement and to generate a fluid pressure in said drilling fluid at a location upstream of the pump arrangement, said generated pressure being equal to or less than a pressure of the sea. For example, said pressure of the sea may be a pressure at the pump arrangement or a sealing means arranged to sealingly abut an outer surface of the drill pipe. The pump arrangement may include at least one hydraulic pump, for example a positive displacement pump, arranged to be supplied with sea water for driving the pump. The pump arrangement may include a centrifugal pump. In particular, the pump arrangement may include a positive displacement pump and a centrifugal pump together operable to lift the drilling fluid toward the surface of said sea. Thereby, the pump arrangement may create a pressure below the seal that is lower than the sea pressure or drilling riser fluid pressure above the seal.

Further features may be defined in relation to the any of the above aspects, as set out in the claims appended hereto and/or in the description below.

It will be appreciated that features relating to any of the above aspects may be combined between aspects in any appropriate combination.

DRAWINGS AND DESCRIPTION

There will now be described by way of example only embodiments of the invention with reference to the accompanying drawings in which.

Figure 1:
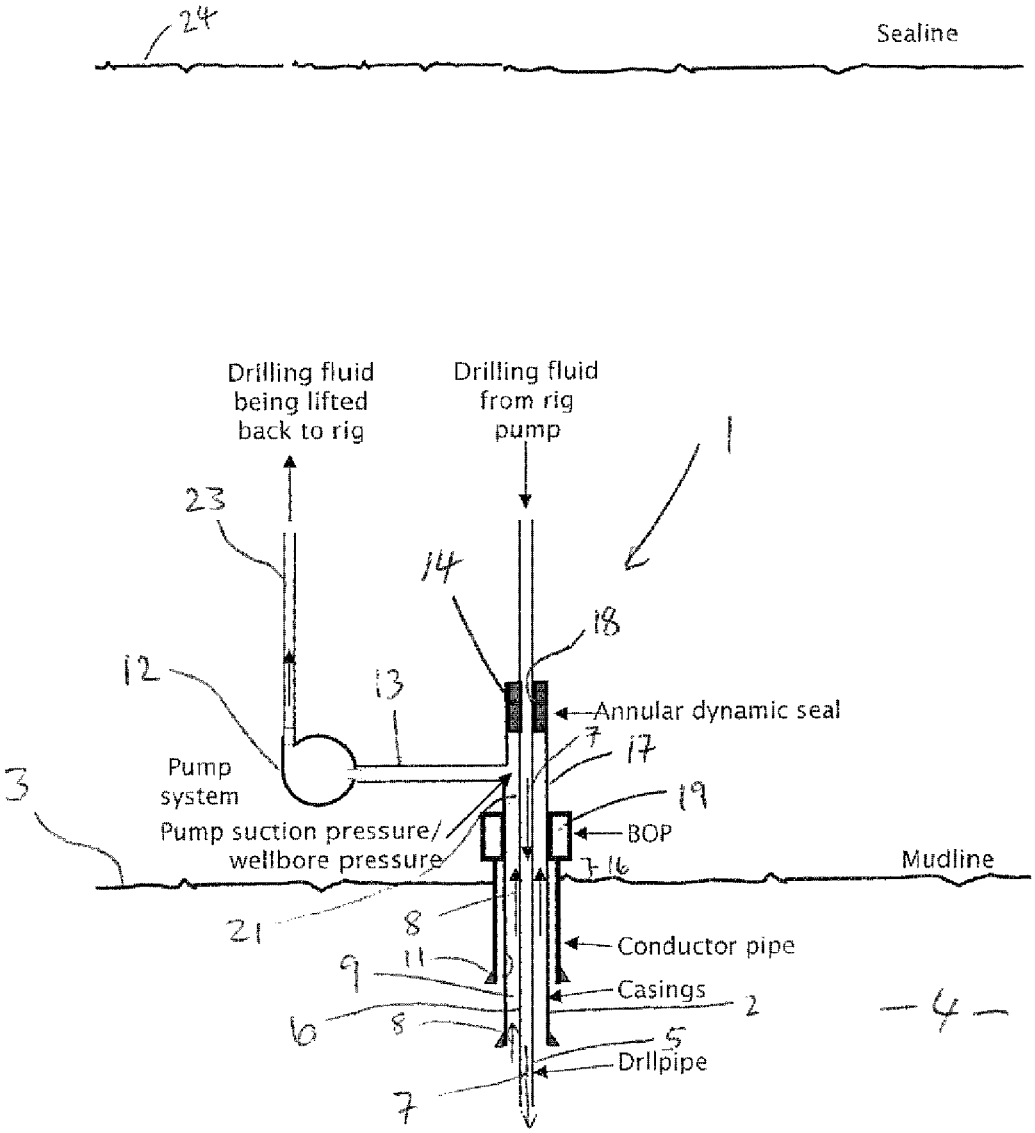
FIG. 1 is a schematic representation of a drilling system comprising apparatus for controlling fluid pressure of a borehole, according to an embodiment of the invention.

With reference firstly to FIG. 1, there is shown a drilling system comprising well control apparatus 1 for controlling the pressure of fluid in a borehole 2. The borehole 2 extends from the ocean floor 3 into the subsurface 4. An upper portion of the borehole 2 is shown in FIG. 1. The upper portion, at least, is lined with a casing, as known in the art.

The apparatus includes drill pipe 5 extending through the sea from a rig at the sea surface into the borehole. At a penetrating end of the drill pipe, there is provided a drill bit (not shown) for drilling into subsurface (rock) formations. During drilling, drilling fluid is conveyed through the inside of the drill pipe, as indicated by arrows 7, and delivered into the borehole at the penetrating end. Typically, drilling fluid is pumped into the borehole through nozzles in the drill bit. The drilling fluid then circulates out of the borehole, along a return path, through the annulus between the drillpipe and the borehole casing. The fluid passes through a region 9 defined between an outer surface 10 of the drill pipe 5 and a wall 11 of the borehole, as indicated by arrows 8.

The drilling fluid can help to lubricate and cool the bit to facilitate drilling. A further purpose of the drilling fluid is to produce an appropriate pressure in the borehole. This may be done by selecting an appropriate density of the drilling fluid.

As the drilling fluid passes out of the borehole, the fluid is conveyed into a subsea pump arrangement 12 located close to the seafloor. Thus, the pump arrangement 12 is in fluid communication with the region 9 so as to receive drilling fluid from the borehole. The pump receives drilling fluid from the borehole through a pump inlet pipe 13. The inlet pipe 13 may be a flexible pipe. The pump is used for lifting the drilling fluid back to the surface rig facility (not shown) where it may be reconditioned and re-circulated in the well.

It can be noted that FIG. 1 shows a "riser-less" drilling configuration. That is, the drill pipe 5 extends from the rig to the sea bed with its outer surface exposed directly to the sea, rather than being placed inside a riser pipe (surrounding and in effect shielding the drill pipe from the sea).

At the seabed, the borehole 2 is provided with a conduit 17 arranged to receive drilling fluid from an upper part of the borehole. The conduit 17 may comprise a casing section 16 extending from the borehole above the seafloor. The conduit 15 defines a flow region 21 between the drill pipe 5 and an inner wall of the conduit for flow of drilling fluid. This flow region 21 is in communication with the region 9 of the borehole for passage of drilling fluid therethrough to the pump arrangement 12.

The conduit 17 is provided with containing means 14 which helps to contain drilling fluid in the space inside the flow region 21 and region 9 of the borehole. The containing means 14 has a dynamic seal 18 (e.g. an RCD) which seals around and against an outer surface of the drill pipe 5. The drilling fluid is circulated adjacent to the drill pipe 5 at localities below the seal 18. Above the seal 18, in this example, the drill pipe 5 is exposed directly to seawater. The containing means and seal 5 prevents seawater from entering into the borehole (i.e. region 9), whilst allowing the drill pipe to rotate and move axially for performing drilling.

Below the seal 18, drilling fluid from the bore is diverted away from the flow region in the conduit 17 and region 9 of the borehole, into the pump arrangement 12. The pump arrangement 12 may include an inlet pipe 13 which fluidly connects with the borehole. The well top 17 may have diverting means for diverting the drilling fluid into the inlet pipe 13 to the pump arrangement 12.

The system is provided with a blow out preventer 19 for sealing the borehole from above-lying equipment to prevent the event of a blow out. In this case, the connecting inlet pipe connects with the borehole between the blowout preventer and the seal. More specifically, it fluidly connects to the borehole region 9 via the flow region 21. It will be appreciated that in other embodiments, drilling fluid may be diverted away from the borehole region 9 at a different point below the seal.

In the example of FIG. 1, the pump arrangement is placed at approximately the same depth below sea surface as the dynamic seal 18. It will be appreciated that the pump arrangement may for example be installed on the seabed, for example on a seabed frame, or suspended by cable from a floating facility at the sea surface.

Figure 2:
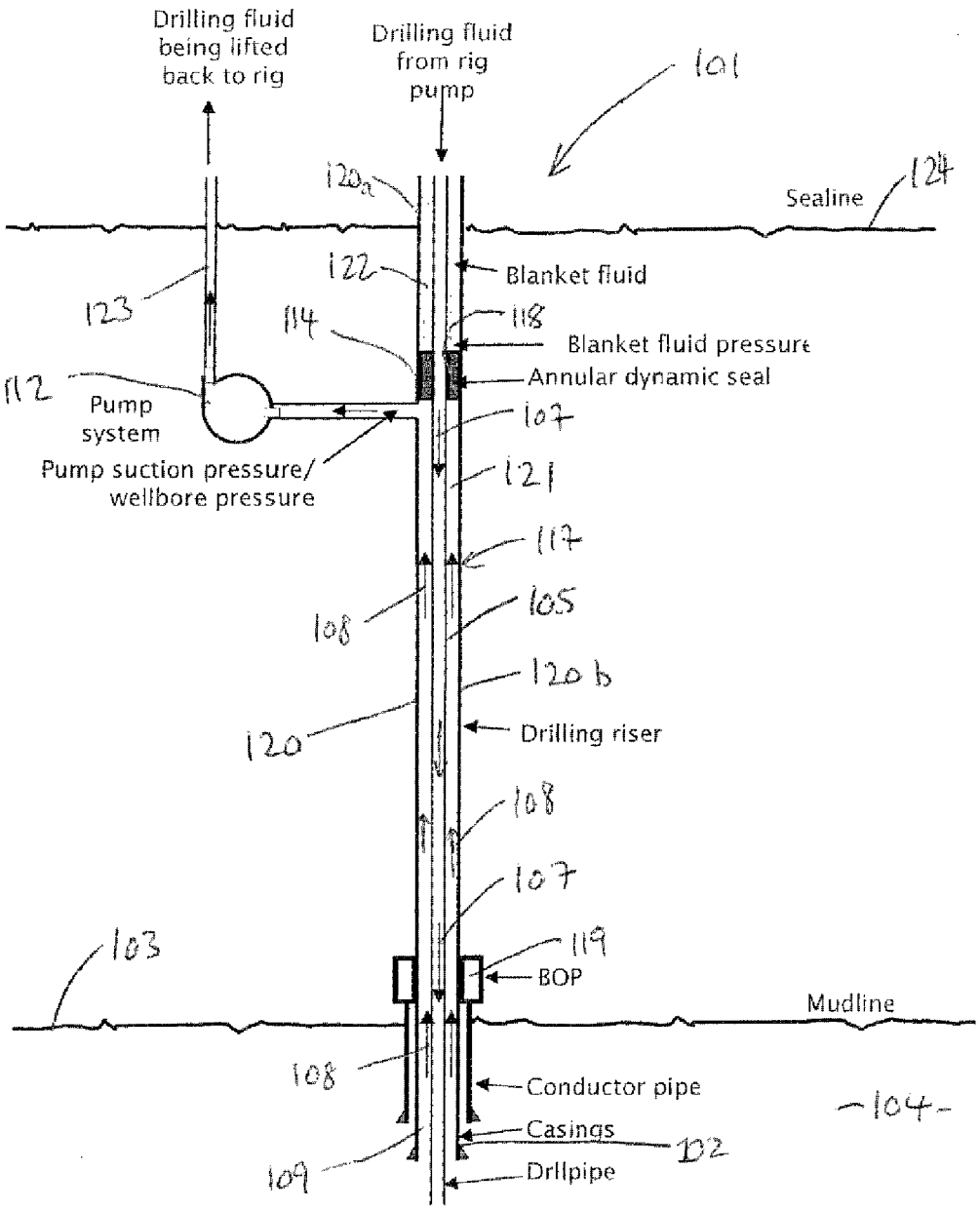
FIG. 2 is a schematic representation of a drilling system comprising apparatus for controlling fluid pressure of a borehole, according to a further embodiment of the invention.

Turning now to FIG. 2, another example of a drilling system is shown comprising apparatus 101 for controlling the pressure of fluid in a borehole 102. The example is similar to that of FIG. 1; like components have the same reference numeral as those of FIG. 1 but are incremented by one hundred.

The FIG. 2 embodiment shows another example drilling configuration. In this case, drill pipe is provided into the borehole from the rig through a drilling riser 120 comprising a first riser section **120*a* extending between the annular seal 118 and the sea surface 121, and a second riser section 120*b* extending between the annular seal 118 and the sea bed. In this case, the conduit 117 comprises the second riser section 120*b*, which constitutes a conduit similar to that of FIG. 1 but extending a greater distance above the seafloor. A flow region 121 is defined inside the riser, between an outer surface of the drill pipe and an inner wall of the riser 120*b* for flow of drilling fluid out of borehole from region 109. The subsea pump arrangement 112 receives drilling fluid diverted out of the region 121 at a point below the seal. The pump arrangement is connected via an inlet tube 113 to the riser section 120*b* at the top of the region 121, in close proximity to the seal 118. For example, the apparatus may be provided with a rotating control device (RCD), including the seal 118 and a diverting means, connected to the riser 120. The RCD may include connectors for connection to the first riser section 120***a* on one side and for connection to the second riser section 120*b* on another side. The pump arrangement is placed at a similar depth below sea surface to that of the seal.

It can be noted that the pump arrangement 12 may in other embodiments be placed at a depth below that of the seal. An operational consideration in this regard is the friction provided in the pipe. In other embodiments, the pump arrangement may comprise a plurality of pumps or pump systems, to act on the drilling fluid returning from the borehole to the surface. Each such pump or pump system may be located at a depth below that of the seal, and/or at different depths to each other. In this way, the working pressure of each pump or pump member can be reduced.

Above the seal, a blanket fluid is provided inside the first riser section 120*a* in a region 122 defined between the outer surface of the drill pipe and an inner surface of the first riser section 120*a*. The blanket fluid sits passively in the region 122 above the seal 118. The blanket fluid has a different density to that of the drilling fluid in the borehole and is typically lower than that of seawater. This fluid may for example be air. This reduces the hydrostatic pressure of a column of fluid acting on the seal from above compared with the example of FIG. 1 seawater present above the seal. It can be noted with regard to FIG. 1, that a column of fluid above the seal can be defined to extend through the sea without the riser being present. Such a column may be defined at least partly along the length of the drill string, for example by the outer surface of the drill string that is exposed to the sea. A "dual gradient" pressure gradient with depth is created from the sea surface to the bottom of the borehole. A first gradient is created from the sea surface to the seal, and a second gradient is created due to the presence of the drilling fluid from the seal to the bottom of the borehole. A dual gradient is also created with a "riserless" drilling configuration as shown in FIG. 1.

Dual gradient configurations provide advantages particularly in deep water drilling, and allow stresses on the drilling equipment in the water column to be reduced. Steeper gradients are created for the interval below the seal to improve the margins for safe operation with respect to the formation pressure.

The subsea pump arrangement 112 is needed where dual gradient drilling configurations such as shown in FIGS. 1 and 2 are used in order to lift the drilling fluid to the surface 124.

Figure 3:
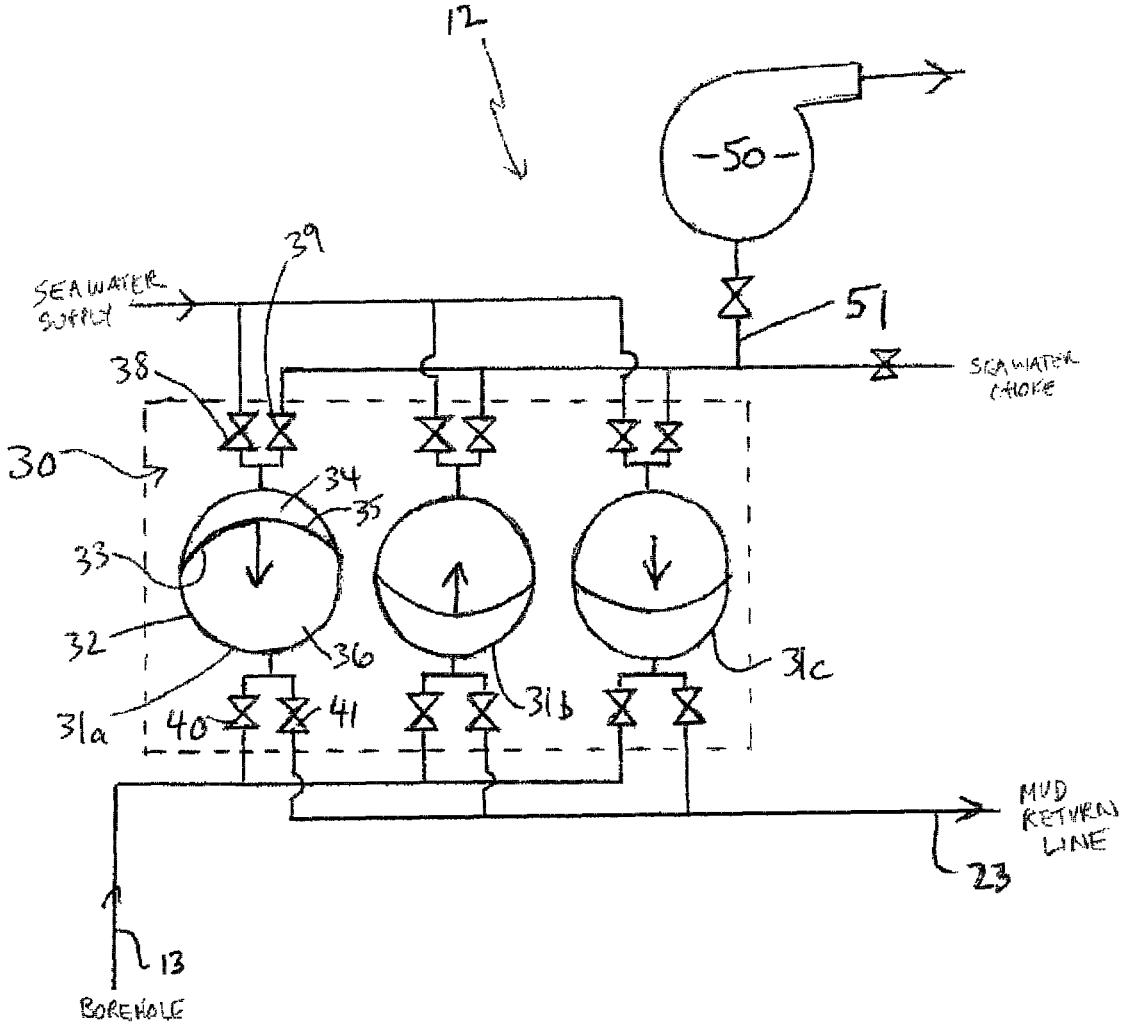
FIG. 3 is a schematic representation of a pump arrangement for use in the drilling system of FIG. 1 or FIG. 2.

With further reference now to FIG. 3, the pump arrangement 12 for a drilling system 1 as described above is described in more detail. The pump arrangement 112 for the drilling system 101 is configured similarly.

As mentioned above, the pump arrangement 12 is used for lifting the drilling fluid to the surface, to a facility such as a rig. In addition, the pump arrangement 12 is used for controlling the pressure of the drilling fluid in the borehole 2. In particular, the pump arrangement 12 is configured to produce a pressure upstream of the pump arrangement 12, e.g. in the borehole 2 such as region 9, or in the region 121 of the riser, that is lower than the hydrostatic pressure acting at the location of the seal or at the location of pump arrangement 12. The pressure below the RCD can be adjusted to maintain a desired borehole pressure. The pressure across the RCDI can be negative up to a nominal 50 bar, but is not so limited. The pressure produced by the pump arrangement is typically up to around 50 bar lower than the prevailing hydrostatic pressure at the abovementioned seal or pump locations, but is not limited to that range. The location of the seal and/or pump may be at any subsea location, between the sea surface 124 and the seabed 103.

The pump arrangement 12 includes a positive displacement pump 30 and a centrifugal pump 50 which co-operate to lift the drilling fluid to the surface. The positive displacement pump 30 is driven by drive fluid in the form of seawater. The centrifugal pump 50 is connected to the positive displacement pump 30 so that it receives drive fluid from the positive displacement pump 30, and operates to control the pressure in the drive fluid. By changing the pressure in the drive fluid, on the "drive side" of the positive displacement pump, the intake of drilling fluid by the positive displacement pump can correspondingly be controlled. By applying the centrifugal pump to the drive fluid of the positive displacement pump, a desired suction pressure can be provided by the pump arrangement. Pressures upstream of the pump arrangement may therefore be generated as explained above.

The positive displacement pump 30 in this example comprises three pump members 31*a-c*. Each pump member has a housing 32 with a movable drive member in the form of a diaphragm 33 movably located within the housing. The pump member 31*a* is described as an example of how each such member may be configured. With reference to pump member 31*a* therefore, it can be seen that the housing has a drive chamber 34. The drive chamber is defined on a first side of the diaphragm. The drive chamber is arranged to receive therein a drive fluid in the form of seawater. The seawater may be supplied from the sea surface. The seawater received in the drive chamber acts against the diaphragm for moving the diaphragm within the housing. In particular, the seawater may impart a force against a drive surface 35 of the diaphragm to move the diaphragm. The pump member has a drive fluid inlet arrangement 38 for flow of seawater into the chamber 34 and a drive fluid outlet arrangement 39 for flow of seawater out of the drive chamber 34.

The housing also includes a discharge chamber 36. The discharge chamber 36 is defined on a second side of the diaphragm 33. The discharge chamber 36 is arranged to receive therein drilling fluid from the borehole 2. The diaphragm is configured to act on the drilling fluid received in the chamber 36 such that drilling fluid can be discharged from the chamber upon movement of the discharge member within the housing. The pump member has a discharge fluid inlet arrangement 40 for flow of drilling fluid into the chamber 36 and a discharge fluid outlet arrangement 41 for flow of drilling fluid out of the discharge chamber 36.

The inlet arrangements 38, 40 may include controllable flow valves on respective inlets, for closing or opening the inlets for controlling fluid flow into the respective chambers. Likewise, the outlet arrangements 39, 41 may include controllable flow valves on respective outlets for closing or opening the outlets for controlling fluid flow out of the respective chambers.

A pump cycle for each pump member may be as follows:

a. The drive chamber is initially emptied of seawater, the drive fluid inlet 38 being closed. The discharge fluid inlet is open, and drilling fluid is permitted to flow through the discharge fluid inlet 40 into the discharge fluid chamber 36. In this way, the pump member takes in drilling fluid. The discharge fluid outlet 41 is closed. The diaphragm is in an initial position within the housing, as shown with reference to drive member 34. In this position, the discharge chamber is at a maximum volume, whilst the drive chamber is at a minimum volume.

b. The drive fluid inlet 38 and discharge outlet 41 are opened. The drive fluid outlet and discharge inlet are closed. Sea water is then let through the inlet 38 into the drive chamber 34. Seawater acts against the drive surface 35 displacing the diaphragm within the housing to force drilling fluid out of the discharge outlet. As will be appreciated, as the diaphragm is displaced, the volume in the discharge chamber is reduced, causing drilling fluid to be expelled via the discharge outlet 41.

c. The drive fluid inlet 38 and discharge outlet 41 are closed. The drive fluid outlet 39 and discharge inlet 40 are opened. Drilling fluid is let through the discharge inlet 40 into the discharge chamber 36. The drilling fluid may act to help move the diaphragm back to its initial position in step a. However, this may be dependent upon the pressure of the drilling fluid entering the pump relative to the pressure of the seawater outlet. Notably therefore, in this stage of the pump cycle, the centrifugal pump is applied to suck seawater from the drive fluid outlet 39. Fluid is thereby moved out of the chamber 34, facilitated by the centrifugal pump, such that the diaphragm is moved back to the initial position.

As can be seen in FIG. 3, the centrifugal pump 50 has a pump inlet 51 fluidly connected to the drive fluid outlets of the positive displacement pump members 31*a-c*. In this way, the centrifugal pump 50 receives drive fluid from the positive displacement pump 30. The centrifugal pump is electrically driven by an electrical supply from the surface. The pump 50 operates to pump the drive fluid, so as change or reduce a pressure of the drive fluid, the drive fluid being discharged into the sea.

It will be appreciated that the pressure produced or controlled using the centrifugal pump in the drive fluid outlet is communicated across the pump members 31*a-c*. In other words, the pressure change or reduction generated by the centrifugal pump in the drive fluid outlet leads to a corresponding pressure change or reduction upstream of pump arrangement, for example at the inlet 13 for the drilling fluid.

The centrifugal pump can be controlled, for example its speed may be controlled, to produce a pressure upstream of the pump arrangement 12 or of pump 50 for controlling fluid pressure in the borehole. In particular, it may allow a pressure to be produced in the borehole that is lower than the hydrostatic pressure of the column of fluid above the seal, for example 0 to 50 bar lower, as described above.

It will be understood that the centrifugal pump and flow valves at the inlets and outlets to each of the drive chamber and discharge chamber may be controllable using a control system, for example a managed pressure drilling (MPD) control system. There will therefore typically be control or power lines connecting such valves or pump to the control system. The timing of the opening and closure of valves may be controlled accordingly to control the pump cycle, for example the start and end of the different phases a. to c. of the pump cycle, for each pump member. The centrifugal pump may be operated in response to a measured condition in the borehole, for example a pressure measurement of well fluid from the well. A pressure measurement device may for example be fitted to the inlet 13 to measure pressure of fluid therein.

It will be understood that the pump cycles of the individual pump members 31*a-c* may be offset with respect to each other, as indicated by FIG. 3. Thus, when the discharge chamber of one pump member is receiving drilling fluid from the borehole (pump member 31*b*), drilling fluid may be being discharged from another (pump member 31*c*). In this way, a continuous output of drilling fluid can be pumped to the surface via a return line 23. Typically therefore, the centrifugal pump may operate continuously. The pump arrangement as a whole may therefore provide a consistent output. The cycle per minute rate of each pump member is regulated according to the drive fluid volume.

The invention described provides a number of advantages. In particular, by producing a pressure upstream of the pump arrangement that is significantly lower than the hydrostatic pressure of a column of fluid above the level of the seal, the borehole pressure can be reduced to facilitate removal of drilling fluid from the borehole. By use of the presently described pump arrangement, the generated pressure can be controlled, for example according to conditions in the well, and this may be useful to facilitate close control of borehole pressure which is of importance particularly when there are tight pressure margins for drilling. The pressure in the well may be reduced to compensate for conditions and events leading to pressure changes in the well during drilling.

The centrifugal pump facilitates the intake of drilling fluid by the positive displacement pump. Thus, the drive member of the positive displacement pump can be returned by the drilling fluid to a start position before it acts to discharge the drilling fluid from the discharge chamber. The start position may be where the drive member is maximally displaced within the housing and the drive chamber volume is greatest, at the top of the pump units as seen in FIG. 3.

The term "sea" should be understood to include usage in land locked or partially land locked seas, such as lakes, fjords or estuarine channels, in addition to open seas and oceans. Accordingly, it will be understood that the term "sea water" could encompass salt water or fresh water, and mixtures thereof.

Various modifications and improvements may be made within the scope of the invention herein described.

The invention claimed is:

1. An apparatus for drilling and controlling a fluid pressure of a borehole during said drilling of the borehole, the apparatus comprising:

a drill pipe arranged to be located in said borehole, said drill pipe configured to provide a drilling fluid to the borehole;

a seal or rotary control device arranged to sealingly abut an outer surface of the drill pipe to separate said drilling fluid in the borehole on a first side of the seal or rotary control device from a fluid on a second side of the seal or rotary control device;

a subsea pump arrangement arranged to be located under a sea surface, said pump arrangement arranged to receive therein a flow of said drilling fluid from the borehole;

wherein said pump arrangement is operable to pump said received drilling fluid out of the pump arrangement and to generate a fluid pressure in said drilling fluid at a location upstream of the pump arrangement, said generated pressure being less than or equal to a hydrostatic pressure of said fluid on said second side of the seal or rotary control device, wherein said pump arrangement comprises: a positive displacement pump configured to be driven using a drive fluid; and a centrifugal pump arranged to receive said drive fluid from the positive displacement pump and operate to pump the drive fluid to change or control a pressure in said drive fluid, and wherein said drive fluid is seawater.

2. The apparatus as claimed in claim 1, wherein the generated pressure is in a range of up to around 50 bar less than said hydrostatic pressure.

3. The apparatus as claimed in claim 1, wherein said location upstream of the pump arrangement is within said borehole.

4. The apparatus as claimed in claim 1, wherein said location upstream of the pump arrangement is at an inlet of the pump arrangement.

5. The apparatus as claimed in claim 1, wherein the seal or rotary control device is arranged to be positioned at a depth below the surface of the sea.

6. The apparatus as claimed in claim 1, wherein the seal or rotary control device is arranged to be positioned at or above the seafloor.

7. The apparatus as claimed in claim 1, wherein the pump arrangement is arranged to be placed at substantially the same depth below the sea surface as the seal or rotary control device or at a depth below that of the seal or rotary control device.

8. The apparatus as claimed in claim 1, wherein in use, said fluid on the second side of the seal or rotary control device overlies the seal or rotary control device and the drilling fluid on the first side of the seal or rotary control device.

9. The apparatus as claimed in claim 1, wherein said fluid on the second side of the seal comprises fluid having a lower density than that of the drilling fluid in the borehole.

10. The apparatus as claimed in claim 1, wherein said fluid on the second side of the seal comprises seawater.

11. The apparatus as claimed in claim 1, wherein said fluid on the second side of the seal comprises fluid having a density lower than that of seawater.

12. The apparatus as claimed claim 1, wherein the positive displacement pump comprises:

a drive member arranged to act on said drilling fluid received in the pump arrangement;

a drive chamber arranged to receive the drive fluid for exerting a force against said drive member to drive said drilling fluid out of the pump arrangement; and a drive fluid inlet comprising a first controllable flow valve for directing the drive fluid into said drive chamber and a drive fluid outlet comprising a second controllable flow valve for directing the drive fluid out of said drive chamber;

wherein the centrifugal pump is arranged to receive the drive fluid from the drive chamber, and is operable to pump said drive fluid to control a pressure in the drive fluid upstream of the centrifugal pump.

13. The apparatus as claimed in claim 1, further comprising a controller to control the operation of the pump arrangement.

14. The apparatus as claimed in claim 1, wherein the pump arrangement is controllable to control said drilling fluid pressure upstream of the pump arrangement.

15. The apparatus as claimed in claim 1, which further includes a measurement device for measuring a condition of the borehole, and wherein the pump arrangement is operable in dependence upon said condition to produce said drilling fluid pressure upstream of the pump arrangement.

16. A method of drilling and controlling a fluid pressure of a borehole during drilling, the method comprising the steps of:

(a) providing drill pipe in said borehole;

(b) providing a seal or rotary control device in sealing abutment against an outer surface of said drill pipe;

(c) providing drilling fluid in the borehole through the drill pipe;

(d) using the seal or rotary control device to separate said drilling fluid in the borehole on a first side of the seal or rotary control device from a column of fluid on a second side of the seal or rotary control device;

(e) locating a subsea pump arrangement under a sea surface;

(f) receiving a flow of said drilling fluid from the borehole in said pump arrangement; and (g) generating a fluid pressure in said drilling fluid from the borehole at a location upstream of the pump arrangement by operating the subsea pump arrangement, said generated fluid pressure being less than or equal to a hydrostatic pressure of said fluid on said second side of the seal or rotary control device, wherein said pump arrangement comprises: a positive displacement pump configured to be driven using a drive fluid; and a centrifugal pump arranged to receive said drive fluid from the positive displacement pump and operate to pump the drive fluid to change or control a pressure in said drive fluid, and wherein said drive fluid is seawater.

17. A subsea pump arrangement arranged to be located under a sea surface for use in controlling fluid pressure in a borehole, wherein said borehole is provided with a drill pipe located therein, said drill pipe arranged to provide a drilling fluid in the borehole, said drill pipe being provided with a seal or rotary control device in sealing abutment with an outer surface of the drill pipe, said seal or rotary control device separating the drilling fluid in the borehole on a first side of the seal or rotary control device and fluid on a second side of the seal or rotary control device, wherein the pump arrangement is arranged to receive said drilling fluid from said borehole and is operable to pump said received drilling fluid so as to generate a pressure in said drilling fluid at a location upstream of the pump, said generated pressure being less than or equal to a hydrostatic pressure of said fluid on the second side of the seal or rotary control device, wherein said pump arrangement comprises: a positive displacement pump configured to be driven using a drive fluid; and a centrifugal pump arranged to receive said drive fluid from the positive displacement pump and operate to pump the drive fluid to change or control a pressure in said drive fluid, and wherein said drive fluid is seawater.

18. An apparatus for drilling and controlling a fluid pressure of a borehole during said drilling of the borehole, the apparatus comprising:

a drill pipe arranged to be located in said borehole, said drill pipe configured to provide drilling fluid to the borehole;

a subsea pump arrangement arranged to be located under a sea surface, said pump arrangement arranged to receive therein a flow of said drilling fluid from the borehole;

wherein said pump arrangement is operable to pump said received drilling fluid out of the pump arrangement and to generate a fluid pressure in said drilling fluid at a location upstream of the pump arrangement, said generated pressure being equal to or less than a pressure of the sea, wherein said pump arrangement comprises: a positive displacement pump configured to be driven using a drive fluid; and a centrifugal pump arranged to receive said drive fluid from the positive displacement pump and operate to pump said drive fluid to change or control a pressure in said drive fluid, and wherein said drive fluid is seawater.

* * * * *